United States Patent [19]

Lombard

[11] Patent Number: 4,669,995

[45] Date of Patent: Jun. 2, 1987

[54] FLYING TOY

[76] Inventor: Paul W. Lombard, 15 Lawrence St., Woburn, Mass. 01801

[21] Appl. No.: 689,313

[22] Filed: Jan. 7, 1985

[51] Int. Cl.[4] ..... A63H 27/00

[52] U.S. Cl. ..... 446/48

[58] Field of Search ..... 446/46, 47, 48; 273/424, 425; 244/34 A

[56] References Cited

U.S. PATENT DOCUMENTS

| | | | |
|---|---|---|---|
| 3,359,678 | 12/1967 | Headrick | 446/46 |
| 3,765,122 | 10/1973 | English | 446/48 |
| 3,935,663 | 2/1976 | Leibowitz | 446/48 |
| 4,132,030 | 1/1979 | Lehman | 446/46 |
| 4,157,632 | 6/1979 | Everett | 446/46 |
| 4,203,249 | 5/1980 | Böhm | 446/48 |
| 4,212,131 | 7/1980 | Ross, Jr. | 446/46 |
| 4,354,326 | 10/1982 | Mathews | 273/424 |

FOREIGN PATENT DOCUMENTS

| | | | |
|---|---|---|---|
| 2031745 | 4/1980 | United Kingdom | 446/48 |

*Primary Examiner*—Mickey Yu

[57] ABSTRACT

A circular rotating aerodynamic toy for launching by hand with a spinning motion and which may be caught in flight by hand, has an outer peripheral rim or skirt with a free lower portion and an upper portion that connects to the circular body of the toy, the skirt being segmented and attached to the body at a multitude of discrete points around the outer periphery of the body so that between the discrete points of connection the body is free to bend and flex about diametric lines passing through any position on the periphery of the toy, whereby the toy is substantially more flexible than it would be if the attachment of the skirt to the periphery of the body were continuous around the periphery, and so impact forces of the toy upon colliding in flight with another body are minimized.

10 Claims, 13 Drawing Figures

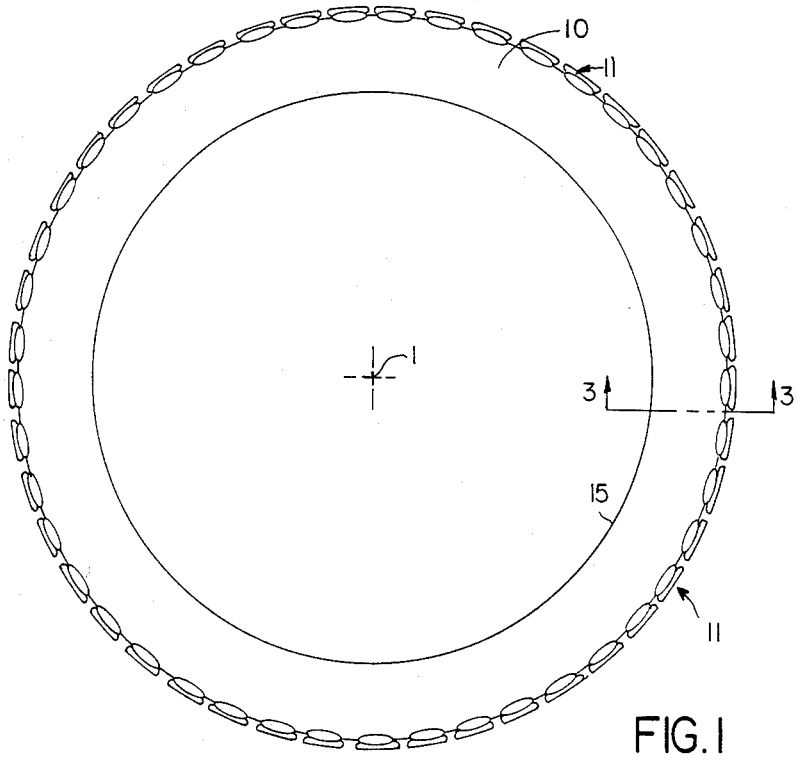
FIG. 1
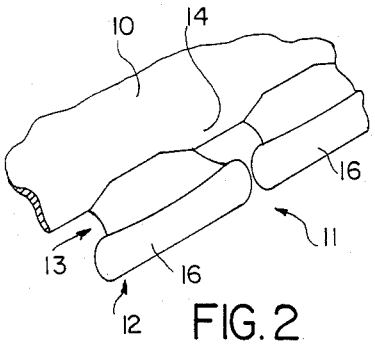
FIG. 2
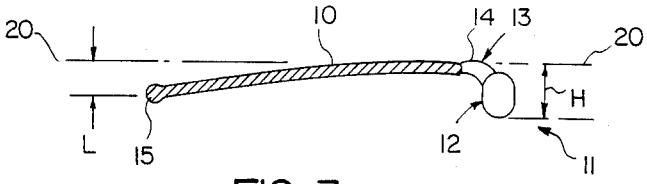
FIG. 3
FIG. 4
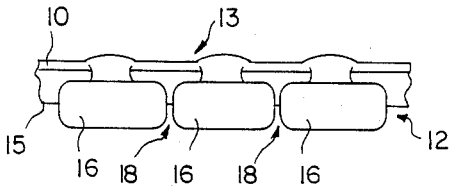
FIG. 5
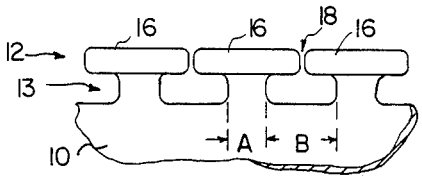

FLYING TOY

BACKGROUND OF THE INVENTION

This invention relates to rotating aerial toys adapted to be sailed in the air in an aerodynamic manner and, more particularly, to rotating ring or disc shaped devices that are scaled into the air for amusement and games that have become popular in recent years as toys, games and objects to be thrown or tossed and caught between individuals for sport and which are launched by hand by imparting a spinning motion to the toy as it is launched and it is sustained in flight by aerodynamic and gyroscopic forces that are brought into play when it is launched.

Aerodynamic circular discs are popularized by the "Frisbee" and aerodynamic rings that are used in sport and games. Such flying toys include a circular center body and a continuous extending rim or skirt around the outer periphery of the body, all formed of a suitable, thin-walled synthetic resin, like a polyethylene. Thus, the rim has a free lower portion and an upper portion that continuously adjoins the center body of the toy. This configuration gives the outer periphery a continuous top or outer surface that resembles an airfoil. It also enables launching the toy with a backhand throwing motion with the fingers gripping around the free lower portion of the rim and the thumb against the upper portion and releasing it into spinning flight with a turn of the wrist so that foreward momentum and spin are imparted to it causing it to fly or glide toward a target. The flight path from the thrower depends on the throwers skill, the release point, the angle of the plane of the toy body to the ground and wind forces during flight.

An example of this type of toy in which the body is disc-shaped is disclosed in U.S. Pat. No. 3,359,678 to Headrick. An example in which the body is ring-shaped is disclosed in U.S. Pat. No. 3,765,122 to English. These constructions provide for an inherently rigid toy, due to the continuous extending rim or skirt even though the toy is made of thin-walled synthetic resin so that it is light. Lightness is desired for ease of launching and reduced impact force when it hits a stationery object while in flight. However, these toys are quite rigid and when they hit a stationery object, the impact force on the object can be excessive. If the toy were less rigid so that it would flex, bend and/or fold on impact, the impact force would be less, all other factors being the same.

The aerodynamic drag on an aerial toy of the type described herein is determined primarily by the height of the rim at the outer periphery. This drag tends to be minimal when the outer rim is absent, as in the example described in U.S. Pat. No. 4,104,822 to Rogers. However, the smaller the rim height, the smaller will be the contact area of the outer perimeter that contacts an object when the toy is in flight; and the smaller the contact area, the greater will be the contact pressure for the same impact force. Accordingly, the rim height should be chosen so that a compromise is obtained between minimal drag and minimal impact pressure. If the toy flexes, bends or folds easily on impact, the impact force is reduced and impact pressure is reduced. Hence, the best compromise is acheived for smaller rim height and, therefore, lower drag as compared with conventional aerial toys of this sort that have a continuous rim that does not flex, bend or fold.

SUMMARY OF THE INVENTION

It is an object of the present invention to provide a rotating aerodynamic flying toy that is circular in shape and relatively light that it can be thrown into flight by hand and will glide a considerable distance and upon impact with a stationery object will bend, flex and/or fold and so reduce the impact forces on the stationery body.

It is another object to provide a "Frisbee"-like aerodynamic toy that has an aerodynamic profile and will readily bend, flex and/or fold when it impacts in flight upon a stationery object so as to reduce the force of the impact on the body.

It is a further object that the bending, flexing and/or folding of the toy not cause any permanent deformation of the toy.

It is another object to provide a ring-shaped aerodynamic toy of the kind that is launched by hand in which a spinning motion is imparted to the toy as it is launched, that has an airfoil cross section and is light weight and is flexible and will bend and/or fold upon impact at the outer periphery of the toy with a stationery body so that the force of the impact is reduced, while at the same time incurring little or no permanent of the toy.

It is another object of the present invention to provide a rotating aerodynamic flying toy of the type shown and described in U.S. Pat. No. 3,765,122 to English, having improved aerodynamic performance.

A disc-shaped or ring-shaped rotating flying toy according to the present invention is comprised of a disc-shaped or ring-shaped body and a peripheral rim, flange or skirt so that, in cross section, the toy exhibits an airfoil shape and experiences lift when it is thrown into the air. The body of the toy is made of relatively thin-walled plastic and the rim or skirt at the periphery of the body has a free lower portion and an upper portion that attaches to the body. Together, the body and the skirt define the airfoil shape and the rim also enables the user to grip the toy by curling fingers around the free lower portion while the palm of the hand extends around the upper portion and top of the toy when it is oriented for flight. The thumb can be placed against the upper portion of the rim or against the top of the body. With this grip the user throws the toy with an outward backhand motion while holding it essentially horizontal and snapping the wrist backward. According to features of the present invention, this toy is made flexible so that it will flex, bend and/or fold upon impact with a stationery object by making the rim in a multitude of segments, preferably evenly spaced,around the full periphery of the toy body. The spacing between segments of the rim is sufficient that the aerodynamic qualities of the toy are not significantly hindered by its flexibility about any diametrical line of the toy.

In a preferred embodiment of this type, the thin-walled ring-shaped body has a substantially flat cross-section and the spacing between segments where the segments join the ring-shaped body is sufficient that the resistance to such flexing or bending is little more than the resistance to bending of the flat ring-shaped body; and concomitantly, any permanent deformation incurred in bending is little more than the permanent deformation incurred by the bending of the thin-walled ring-shaped body. It is very important to maintain aerodynamic stability of the toy in flight and that the toy, while being flexible, be at the same time resistant to permanent deformation that would change the aerodynamic balance of forces that would, for example, cause the toy to turn to the left or right in flight instead of flying straight ahead. An aerial toy of the type described herein which has a great resistance to permanent deformation in bending will, of itself, return to its original shape after being bent or flexed. This resistance to permanent deformation is augmented by molding the toy of a suitable strong synthetic resin, like a polycarbonate, which has a high yield stress in bending; and also, by molding the toy body in a thin and substantially flat cross-section so that it can be bent or flexed to a great extent without causing the yield stress of the material to be exceeded.

Several embodiments made according to this design are described herein and all include the above features. These embodiments range from one with a great many gaps in what would otherwise be a continuous extending rim around the periphery, to embodiments in which the upper portion of the individual rim segments are narrower in the circumferential direction than the lower portion thereof.

These and other objects and features of the present invention can be fully understood from the following detailed description of the embodiments taken in conjunction with the drawings.

DESCRIPTION OF THE DRAWINGS

FIG. 1 is a top view of an aerial toy of which the body is a circular ring that has a rim at the outer periphery extending therefrom in accordance with features of the present invention;

FIG. 2 is a perspective view of the edge of the ring showing the attachment of the rim thereto;

FIG. 3 is a cross-section view of the ring and rim showing the airfoil shape thereof and dimension parameters;

FIG. 4 is an edge view of a portion of the toy showing the rim segments;

FIG. 5 is a bottom view of a portion of the outer periphery showing the rim segments and the separate attachment of each segment to the periphery of the rim;

DESCRIPTION OF EMBODIMENTS OF THE INVENTION

Figure 6:
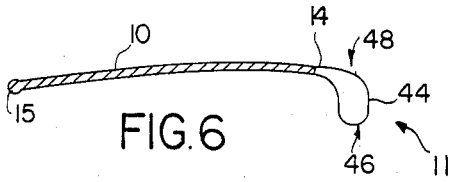
FIGS. 6, 7 and 8 are three views of another embodiment of relatively simple construction and are taken in the same way as FIGS. 3, 4 and 5, respectively.

Referring first to FIGS. 1 to 5, there is shown in these several views a ring-shaped aerial toy that can be grasped by the ring body 10 with the palm of the hand along the outer periphery and held with the outer rim portion 11 pointing downward. It is launched by a backhand motion of the arm and released with a backward snap of the wrist that gives it a spin about a vertical axis 1 through the geometric center of the toy. Due to the aerodynamic shape of the toy and the spinning motion imparted to it when it is launched, it tends to fly in a predetermined trajectory through the air. The aerodynamic characteristics are contributed by the peripheral rim 11 and the cross-section airfoil shape of the ring body and rim as explained further herein.

The rim 11 has a lower portion 12 and an upper portion 13 which is attached to the ring body 10 of the toy. The distinctive characteristic of the toy is that the rim 11 is segmented at a multitude of points around the periphery of the toy and these segments are individually attached to the outer periphery of the ring 10 at the edge 14. Thus, the segments 16 are circumferentially separated from each other sufficiently so that the rim does not impede flexing, bending or folding of the body 10 about any diametric line of the toy.

FIG. 2 is a three-quarter view from above showing a portion of the outer periphery of the toy with a segmented rim 11 and showing the attachment of the adjacent segments 16 to the ring body 10 along the outer periphery thereof. Each rim segment like 16 is attached to the edge 14 of the body 10 by the spoke-like upper portion of the rim segment 13. This arrangement of rim segments at the outer periphery of the body 10 is shown also in FIGS. 4 and 5 which are edge and bottom views, respectively, of a portion of the outer periphery of the toy.

As shown in FIGS. 4 and 5, there are small gaps 18 between the bottom portions of the segments 12. These gaps 18 allow the bottom portions 12 to bend closer together without touching when the toy bends or flexes. The upper portion of the rim segments 13 have a dimension in the peripheral direction denoted A and are separated from each other in the peripheral direction by the dimension denoted B. Due to the rigidity of the individual rim segments 16, the portions of the ring body 10 that can accomodate easy bending are the dimensions B between the upper portions of the rim segments 13. Therefore, the ratio B/A is a measure of the flexibility of the toy. The larger that ratio (i.e., the narrower the upper portions 13 in the circumferential direction) the greater will be the flexibility of the toy, all other things being the same.

Referring to the cross-section view in FIG. 3, the inner periphery of the ring body 10 of the toy may have a segmented inner rim at 15, constructed in a manner similar to the rim 11 at the outer periphery of the ring body 10. However, I have found that a simple rounded annular edge at the inner perimeter 15 of the ring body 10, as shown, is satisfactory and preferred. The ring body 10 has a thin-wall cross-sectional shape and may be formed so that the top surface thereof is slightly convex and the bottom surface is slightly concave as shown in FIG. 3, although I have found that a non-cambered surface is also satisfactory.

As shown in FIG. 3, a reference plane 20 intersects the outer perimeter 14 of the ring body 10 and is essentially perpendicular to the axis of rotation 1 of the toy. I have found through experiment that the axial distance L from the reference plane 20 to the inner periphery 15 and the axial distance H from the reference plane 20 to the bottom end of the lower segment portion 12 both have an effect on the aerodynamic balance of forces on the toy. I have found that the toy will tend to fly straight in the direction it is thrown if the difference between L and H is such that there results a balance of aerodynamic forces on the toy. On the other hand if the difference between L and H is such that there is not a balance of forces, the toy will fly a curved path to the right or left of the direction it is thrown and so will not fly straight. I have found that balance is acheived when L is smaller than H.

Figure 7:
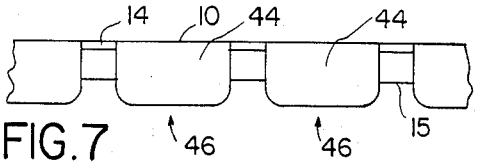
Figure 8:
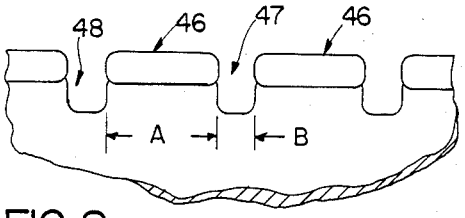

FIGS. 6, 7 and 8 show a relatively simple structure of the segmented rim 11. Here, the lower portion of the segments 46 and the upper portion of the segments 48 are of the same circumferential length, as defined by gaps 47 between the rim segments 44, and together form a uniform extension outward and downward from the edge 14 of the ring body 10. In this configuration, the ratio B/A is substantially less than in the case where the upper portion of the segments are narrower in the peripheral direction than are the lower portion of the segments. Hence, while this configuration is adequate, it is not preferred.

I have found through experiment another effect that contributes to the flexibility of the toy so that it will readily flex, bend and/or fold on impact. I have found that by increasing the axial set-off of the rim from the body of the toy, flexing upon impact is initiated more readily. The flexing is initiated by the bending torque transmitted to the toy body from the segment or segments of the rim contacting another object when the toy is in flight. The greater this axial set-off, the greater is the lever arm of the torque and so the torque is greater, all other factors being the same. This flex-initiating torque causes the toy to bend easily upon impact and so reduce the impact force and pressure on the body impacted.

Figure 9:
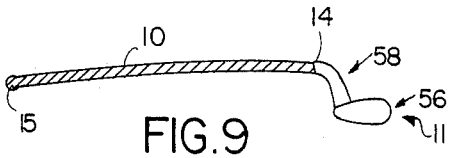
FIGS. 9, 10 and 11 are three views of another embodiment taken in the same way as FIGS. 3, 4 and 5, respectively, and illustrate a configuration wherein the lower portion of the rim segments have an aerodynamic shape for reduced drag.
Figure 10:
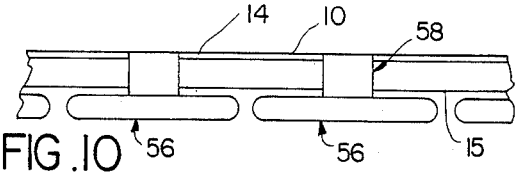
Figure 11:
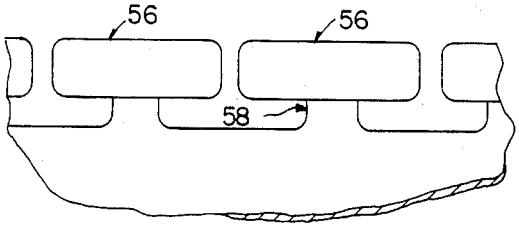

An embodiment of the present invention which takes special advantage of this flex-initiating effect to reduce impact force and pressure on the body impacted is shown in FIGS. 9, 10 and 11. The upper portions of the rim segments 58 in this embodiment are very narrow in the peripheral direction and extend outward and downward from the peripheral edge 14 of the body 10. The narrow extension tends to reduce aerodynamic drag. The lower portion of the rim segments 56 have a cross-section that is elongated in the radial direction and narrow in the axial direction and so presents a low aerodynamic profile in flight for low drag.

The embodiment shown in FIGS. 9, 10 and 11 would impart a relatively high impact pressure to a stationery body that it impacts while in flight, because the impacting outer edge of the segments is a relatively small area. However, this impact pressure is reduced by increasing the axial set-off (increasing H) and so the lever arm, which transmits flexing torque to the body, is increased. By increasing the flex-initiating action in this way, the impact force and impact pressure are reduced to acceptable levels.

Figure 12:
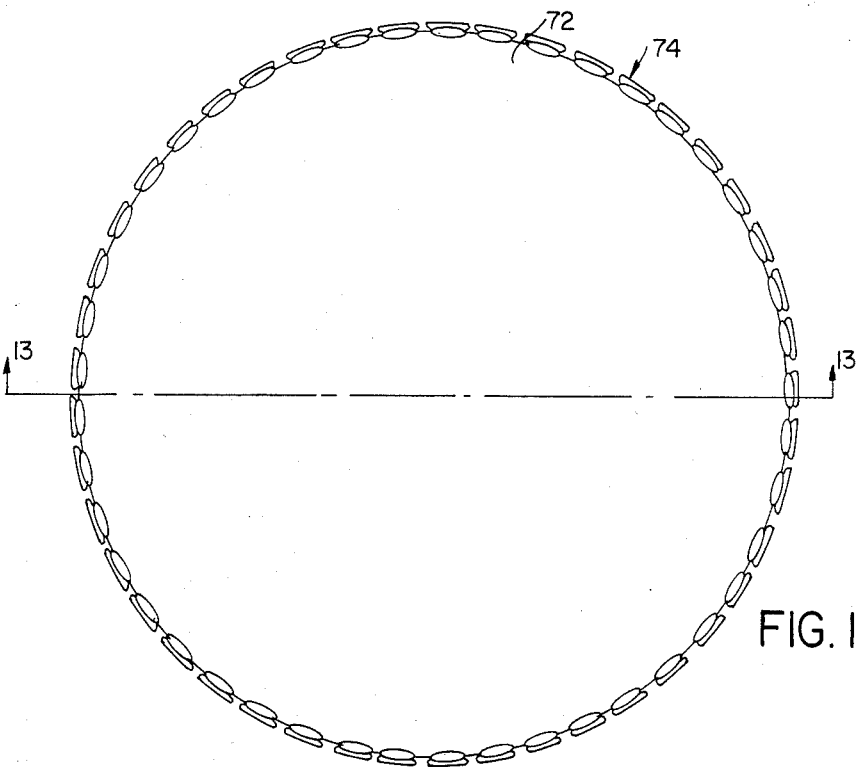
FIGS. 12 and 13 are top and edge views, respectively, of an embodiment wherein the body of the toy is a disc rather than a ring and the segmented rim is essentially the same as shown in FIGS. 2, 4 and 5.
Figure 13:
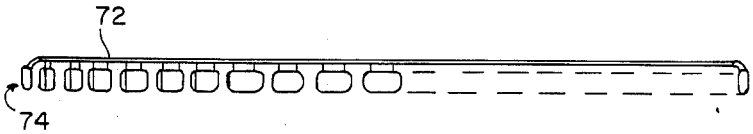

The several embodiments of the present invention for providing the segmented rim so that the toy can readily flex, bend and/or fold, can also be adapted for a flying plate in which the body is disc-shaped rather than ring-shaped. This is illustrated by FIGS. 12 and 13 of which FIG. 12 is a top view showing the disc 72 and segmented rim 74 and FIG. 13 is an edge view. Clearly, the flying toy of this construction does not have the same aerodynamic characteristics as the ring-shaped toys described herein, but its flexibility can be increased by applying the teachings hereinabove.

All features of the present invention are particularly applicable and effective on the ring type aerial toy where the annular body of the toy is thin-walled and has an outer rim or skirt or flange that extends downward from the outer periphery of the ring body so that the cross-section defines an airfoil section. One purpose of the present invention is to make the toy easy to flex, bend or fold about about any diametric line around the periphery so that when it impacts on a stationary object while in flight it will flex or bend and so reduce the impact force on the object and not incur any permanent deformation upon impact, so that the toy retains its original shape, all without interfering negatively with the overall performance of the toy. The features of the invention whereby this is accomplished are described herein in several embodiments all of which are covered by the spirit and scope of the accompanying claims.

What is claimed is:

1. A circular rotating aerodynamic toy for launching by hand in an upright position in which a spinning motion is imparted to the toy as it is launched causing the toy to spin on its axis comprising parts as follows when the toy is oriented in its upright position with its spin axis vertical, (a) a thin-walled circular body having an outer perimeter, (b) a rim attached to said outer perimeter and extending therefrom generally downward, (c) said rim is formed in a multitude of individual segments arranged about said outer perimeter of said thin-walled body, (d) said individual segments are separated from each other around said outer perimeter, (e) said individual segments each have an upper portion that attaches to said body outer perimeter and a lower portion that attaches to and extends downward from said upper portion and (f) said segments upper portions are narrower in the circumferential direction than said segments lower portions, (g) whereby the toy may readily flex and bend about diametrical lines and between said segments.

2. A circular rotating toy as in claim 1 wherein, (a) the circumferential dimension between adjacent ones of said segments upper portions is substantially greater than the circumferential dimension of said segments upper portions.

3. A circular rotating toy as in claim 1 wherein, (a) the circumferential dimension between adjacent ones of said segments upper portions is substantially greater than the circumferential dimension between said adjacent segments lower portions.

4. A circular rotating toy as in claim 1 wherein, (a) said segments lower portions are displaced axially downward and radially outward from said body outer perimeter by said segments upper portions, (b) whereby impact forces imparted to said segments lower portions are transmitted to said body by said upper portions producing a torque thereon tending to bend said body.

5. A circular rotating toy as in claim 4 wherein, (a) the circumferential dimension between adjacent ones of said segments upper portions is substantially greater than the circumferential dimension of said segments upper portions.

6. A circular rotating toy as in claim 4 wherein, (a) the circumferential dimension between adjacent ones of said segments upper portions is substantially greater than the circumferential dimension between said adjacent segments lower portions.

7. A circular rotating toy as claim 1 that has radial dimensions that are horizontal and axial dimensions that are vertical when oriented in said upright position and wherein, (a) said segments lower portions extend free, (b) the circumferential dimension between adjacent ones of said segments upper portions is substantially greater than the circumferential dimension of said segments upper portions and (c) said segments lower portions are displaced axially downward and radially outward from said body outer perimeter by said segments upper portions, (d) whereby impact forces imparted to said segments lower portions are transmitted to said body by said segments upper portions producing a torque thereon tending to bend said body.

8. A circular rotating toy as in claim 1 that has radial dimensions that are horizontal and axial dimensions that are vertical when oriented in said upright position and wherein, (a) said segments lower portions extend free, (b) the circumferential dimension between adjacent ones of said segments upper portions is substantially greater than the circumferential dimension between said adjacent segments lower portions and (c) said segments lower portions are displaced axially downward and radially outward from said body outer perimeter by said segments upper portions, (d) whereby impact forces imparted to said segments lower portions are transmitted to said body by said segments upper portions producing a torque thereon tending to bend said body.

9. A circular rotating toy as in claim 1 that has radial dimensions that are horizontal and axial dimensions that are vertical when oriented in said upright position and wherein, (a) said thin-walled circular body is ring-shaped and has an inner perimeter as well as said outer perimeter and (b) said ring-shaped body slopes downward from said outer perimeter toward said inner perimeter thereof.

10. A circular rotating toy as in claim 1 wherein, (a) said segments lower portions have an aerodynamic cross-section shape in the direction of flight of the toy.

* * * * *